United States Patent [19]

Johnson et al.

[11] 4,072,342

[45] Feb. 7, 1978

[54] RECLINER CHAIR

[75] Inventors: Carl B. Johnson; Henry James, both of Pontiac, Ill.

[73] Assignee: Pontiac Furniture Industries, Inc., Pontiac, Ill.

[21] Appl. No.: 678,702

[22] Filed: Apr. 20, 1976

[51] Int. Cl.[2] ..... A47C 1/02

[52] U.S. Cl. ..... 297/84; 297/318; 297/88

[58] Field of Search ..... 297/85, 88, 316, 318, 297/84, 329, 270

[56] References Cited

U.S. PATENT DOCUMENTS

| | | | |
|---|---|---|---|
| 2,313,023 | 3/1943 | Ruegger | 297/329 |
| 2,492,107 | 12/1949 | Orton et al. | 297/332 |
| 3,322,459 | 5/1967 | Hampton | 297/85 |
| 3,858,932 | 1/1975 | Crum et al. | 297/329 |
| 3,869,169 | 3/1975 | Johnson et al. | 297/84 |
| 3,869,170 | 3/1975 | James et al. | 297/270 |
| 3,869,172 | 3/1975 | James et al. | 297/316 |
| 3,913,152 | 10/1975 | Quakenbush | 297/318 |

*Primary Examiner*—Francis K. Zugel

*Attorney, Agent, or Firm*—Fitch, Even, Tabin & Luedeka

[57] ABSTRACT

A reclining chair is provided with a shiftable chair chassis which travels from a rearward, upright sitting position along a supporting base to a forward position from which the chair may be reclined without striking the wall behind the chair. The chair chassis is normally locked against recline from its rearward, upright sitting position but may be released by the extension of the footrest, which also unlocks the chair chassis for forward travel. Preferably, the chair chassis is mounted upon a downwardly and forwardly inclined track on the chair base so that the weight of the seated occupant is sufficient to shift the chair chassis forwardly on the base upon release of the lock, while counterbalancing means actuated by the forward movement of the chair chassis returns the chair to its rearward position when the occupant rises from the chair.

7 Claims, 10 Drawing Figures

12
14
28
16
15
34
32
19
17

19
14
28
16
12
34
32
192
15
25
17

83
45
20
48
44
44
83
95
161
65
93
98
166
167
97
30
66
17

9.
9.
66
66
72
72
74
75
82
83
83
44
25
46
42
40
48
39
45
95
149
167
161
119
42
60
44
65
61
97
98
111
93
80
68
101
105
104
109
17
46
60
50
48
44
52
42
64
95
97
51
149
39
161
162

RECLINER CHAIR

This invention relates to a reclining chair which may be positioned with its back close to a wall and be reclined without striking the wall, notwithstanding that the upper end of the chair back swings backwardly and outwardly as one shifts the chair back to the reclined position.

Although several manufacturers produce reclining chairs which may be placed closely adjacent a wall and reclined without striking the wall, (see U.S. Pat. Nos. 3,858,932 and 3,874,724) the chairs disclosed in these patents require a substantial effort by the occupant to propel the chair chassis forwardly to provide clearance for the chair back as it swings to a reclined position, as well as to return the chair to the upright sitting position, inasmuch as the shifting of the chair chassis on its base is accomplished by the movement of the reclinable backrest of the chair.

Elderly persons and persons of limited strength, particularly ladies, often find such strength requirements taxing beyond their capabilities. Thus, there is a need for easier shifting of the chair chassis to provide clearance for the backrest to recline without protruding rearwardly to an extent as would strike the adjacent wall behind the chair.

It is accordingly a principal object of this invention to provide a wall-clearing reclining chair which is easily operated without effort by the occupant so as to be equally enjoyable by the frail and the infirm and others of limited strength.

A further object of the invention is to provide a recliner chair in which the occupant's weight provides a sufficient force to shift the chair chassis forwardly on a downwardly inclined track and in which a counterbalancing means actuated by the forward movement of the chair, automatically returns the chair chassis rearwardly when the occupant rises from the chair.

It is a further object to provide a wall-clearing reclining chair which is not reclinable from the normal upright sitting position, but is readily reclinable by the occupant upon the release of a latch accompanied by extension of the footrest.

It is a still further object of the invention to provide a recliner chair which shifts forwardly relative to the base and provides a preliminary adjustment in the angularity of the chair seat and chair back upon extension of the footrest for the so-called intermediate "TV" position, prior to movement to fully reclined position.

Other objects and advantages of the invention will become more apparent from the following detailed description taken in connection with the accompanying drawings in which.

Figure 1:
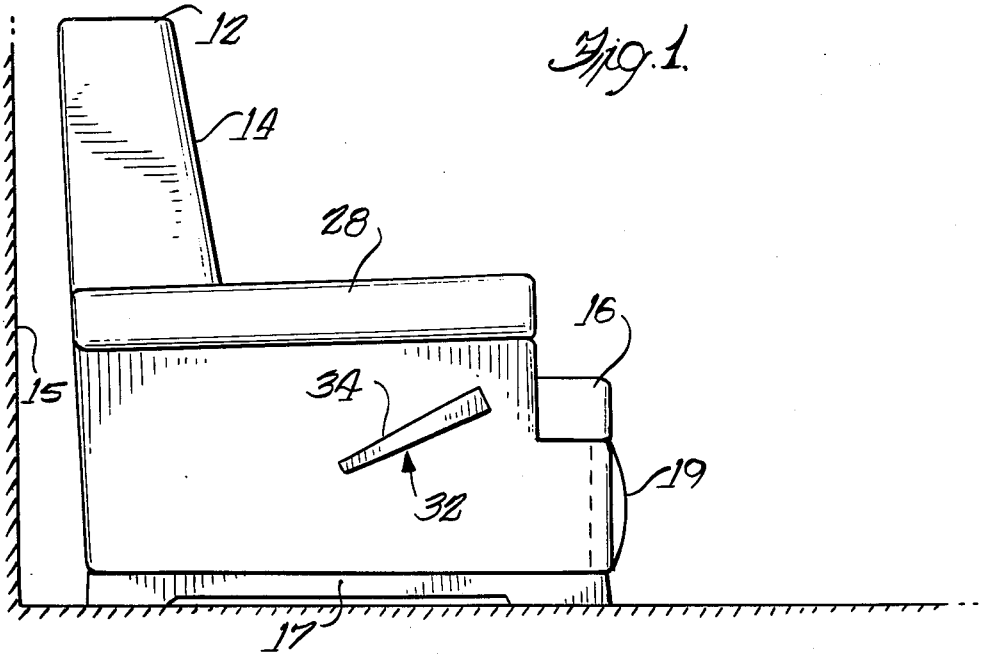
FIG. 1 is a side elevational view of a reclining chair positioned in an upright position with its backrest adjacent a wall and embodying the novel features of the invention.
Figure 2:
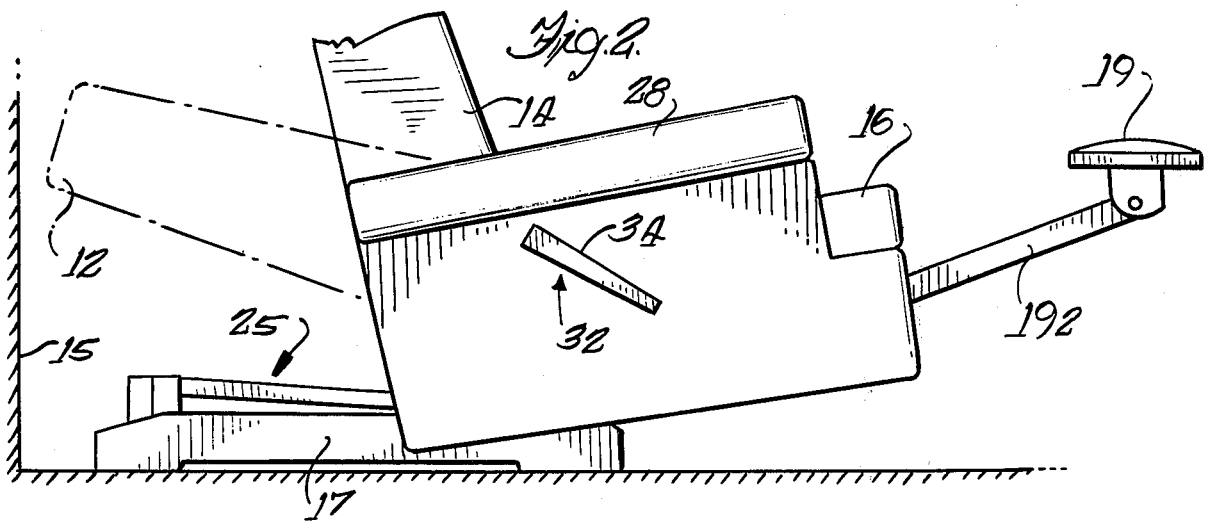
FIG. 2 is a side elevational view of a chair of FIG. 1 with the footrest extended and the chair chassis shifted forwardly on the base, and with the subsequent, fully reclined position shown in dotted outline.

By way of summary at the outset, the recliner chair 11 of the present invention is shiftable by the weight of the occupant from an upright sitting position, as shown in FIG. 1, with the top rearward end 12 of a chair back 14 positioned closely adjacent a rear, vertically extending wall 15 to a forward position, as shown in FIG. 2, in which the chair back and chair seat 16 has shifted forwardly relative to a stationary chair base 17 and to the wall 15, and in which a footrest 19 is extended from its retracted position in which is serves as a front board for the chair (FIG. 1), to support the legs of the occupant at the intermediate TV position (FIG. 2). The legrest remains extended when the chair back 14 is swung downwardly and rearwardly from the forward intermediate or TV position shown in FIG. 2 to the fully reclined position, shown in dotted outline in FIG. 2, in which the upper end 12 of the backrest is positioned at approximately the same distance from the wall 15 as when the chair was in its fully upright sitting position shown in FIG. 1. The chair back 14, the chair seat 16, the legrest 19 and chair arms 28 are carried by a chair chassis 20 mounted on the base 17 for movement between the positions of FIGS. 1 and 2.

In accordance with an important aspect of the invention, the strength requirements associated with the operation of existing wall-clearing recliners, have been eliminated by an inclined support track 25 for the chair chassis 20, which slopes forwardly and downwardly to enable the occupant's weight alone to shift the chair chassis away from the wall behind the chair. The chair arms 28 may be secured to the chair chassis 20 rather than to the chair base, inasmuch as there is no need for the occupant to pull or push on the chair arms to propel himself forwardly, as in commercially available chairs of this general kind.

Figure 6:
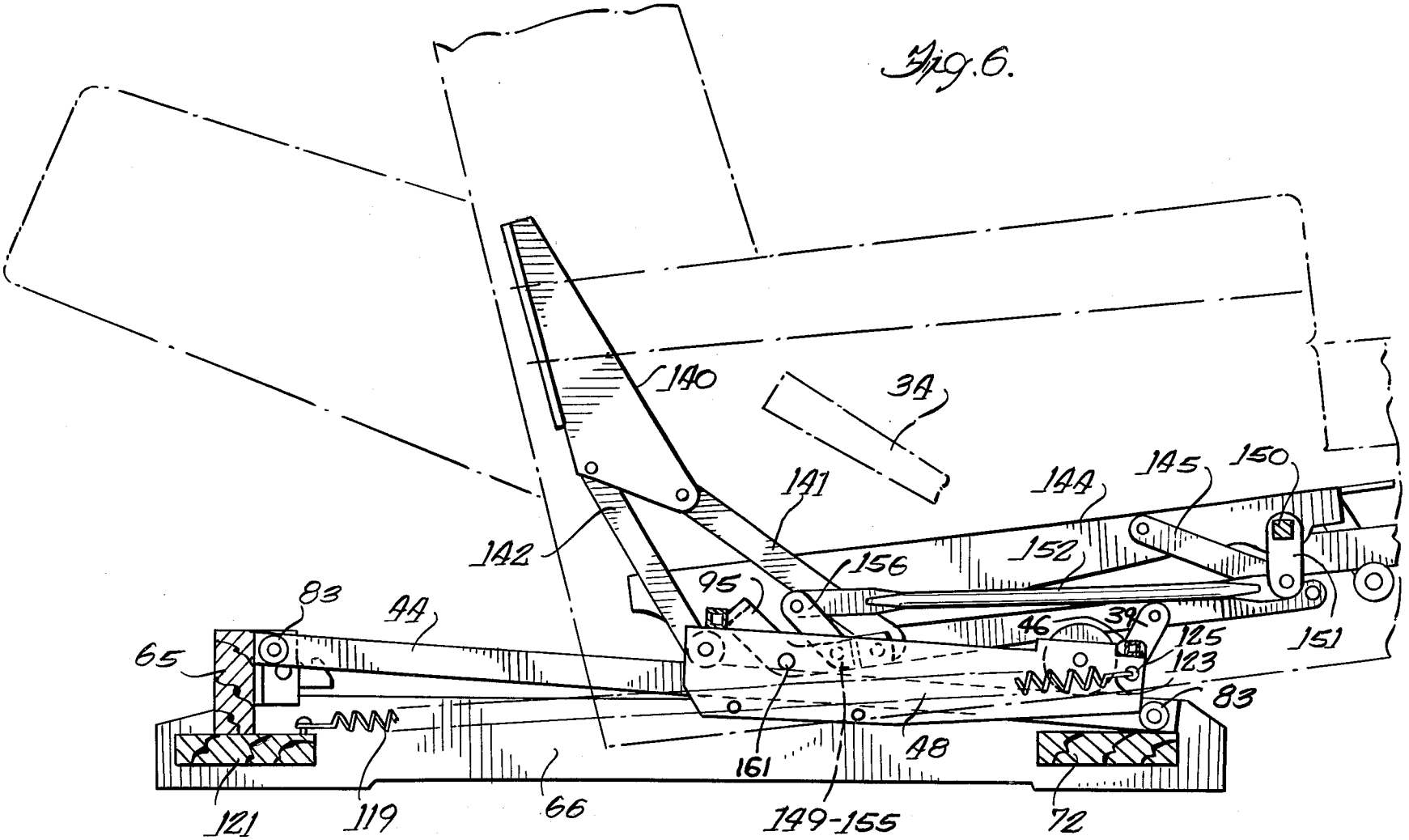
FIG. 6 is a similar interior or sectional elevational view illustrating the chair chassis in its forward position with the legrest extended.

Furthermore, in the preferred embodiment of the invention and as best seen in FIG. 6, a biasing means in the form of a counterbalance spring 29 is connected between the base 17 and the chair chassis 20 to exert a sufficient rearward counter-force on the chassis 20 so that, when the occupant arises from the chair, the spring means 29 automatically returns the chair chassis rearwardly to the upright sitting position, shown in FIG. 1. Thus, persons of limited strength will not be in the awkward situation of trying to push the chair back and seat to the upright position in order to dismount from the chair.

To prevent unintended forward movement, it is preferred that the chair chassis 20 be locked in the sitting position by a latch means 30 so that it takes a conscious and deliberate effort on the part of the occupant to release the latch means 30 to achieve the automatic forward movement of the chair chassis 20 along the inclined track means 25. Herein, the latch means 30 is conveniently connected to and controlled by a manually operable means 32 in the form of a lever 34 which also operates a linkage mechanism 35 (FIG. 4) for the extension of the footrest 19. Thus when the occupant operates the handle lever 34, the chair chassis 20 automatically shifts forwardly to the forward or TV position, shown in FIGS. 2 and 6, with the footrest extended but with the chair back 14 still generally upright.

It will be apparent that the latch means, although desirable and preferred, is not necessary to the invention if one is willing to allow the chair chassis to shift forwardly immediately upon the person becoming seated. Also, it will be apparent that other latch release arrangements may be used as an alternative to the footrest actuating lever 34, including the extension of the footrest in those types of recliners in which the footrest is extended by the shifting of the seat without benefit of hand lever.

In addition to being latched in the "uphill" rearward sitting position, the chair is also locked against recline from that position until the footrest is extended and the retaining latch disabled to permit forward movement under the occupant's weight. Also, the movement of the forward TV position, shown in FIGS. 2 and 6, is accomplished by a slight change in the pitch of the chair back and seat 16 to provide a more comfortable sitting and TV-watching position. As will later be explained in greater detail, both unlocking actions, as well as the pitch adjustment referred to, are accomplished by the same action which extends the footrest. The illustrated linkages for the support and operation of back, seat, and footrest are essentially those of our prior U.S. Pat. Nos. 3,869,169, '170, and '172 which operate in essentially the same way in the present wall-clearing context.

THE MOVABLE CHASSIS CARRIAGE AND TRACKS, AND THE CARRIAGE LATCH

Referring now to a more detailed description of the present invention, the chair chassis 20 includes a carriage 40 (FIG. 7) having flanged rollers 42 engaging the tops of the inclined tracks 25 in the form of a pair of downwardly and forwardly inclined and transversely-spaced parallel bars 44. The carriage 40 comprises a pair of spaced trucks 48 connected together by two cross bars 45 and 46, the rear bar 45 being secured at opposite ends to the opposed trucks 48. The front bar 46 is likewise secured to the opposed trucks 48, but its ends are extended, flattened, and bent down to provide mountings for a pair of links 39 which provide the forward support of the chassis rails 163. The bars 45 and 46 are hollow tubular members secured to the trucks 48 by rivets.

Figures 7, 8, 9:
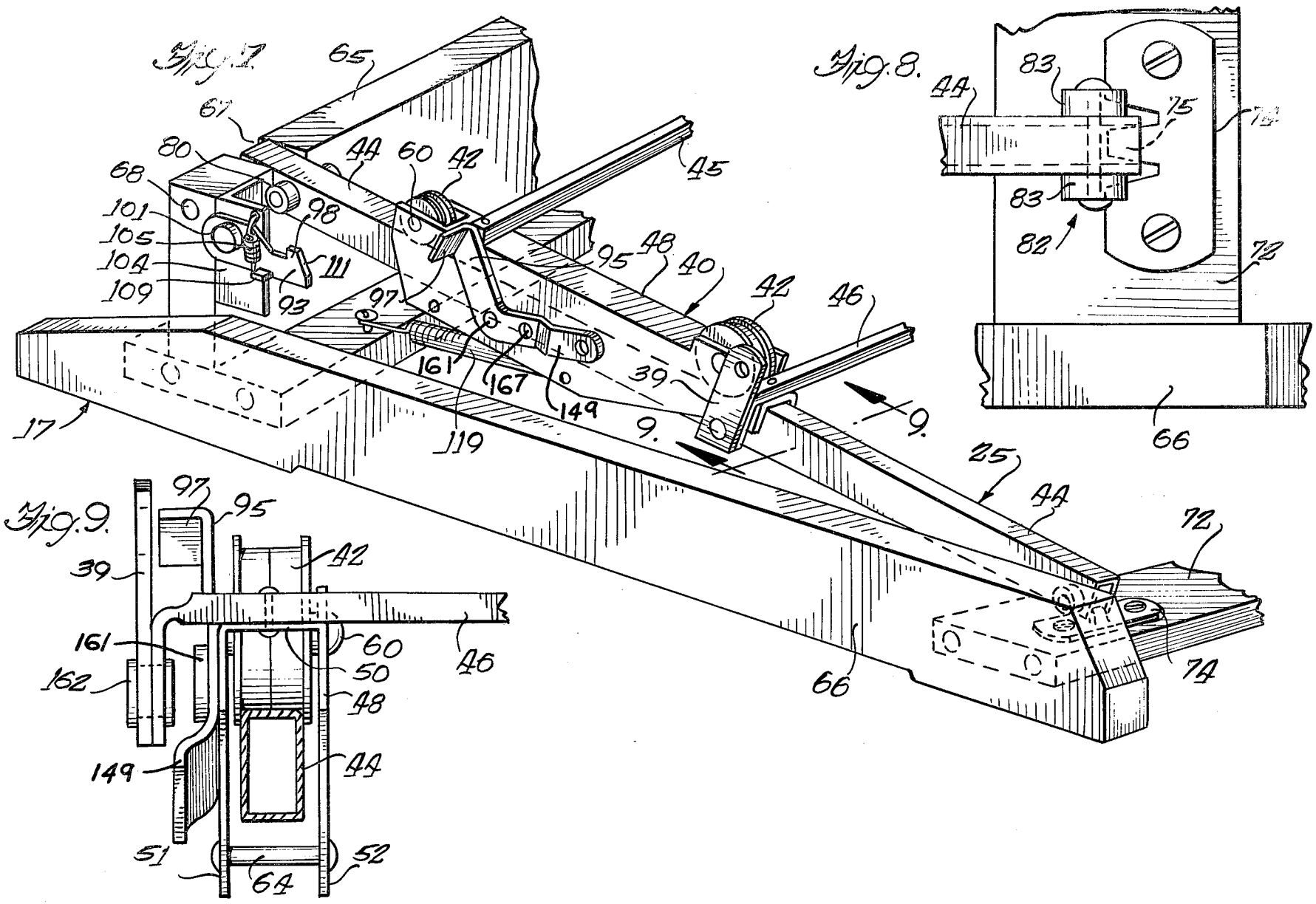
FIG. 7 is a fragmentary, perspective view illustrating the inclined track and the chair-supporting carriage mounted thereon.
FIG. 8 is a fragmentary, enlarged plan view illustrating the connection of the lower front end of the track to the chair base.
FIG. 9 is a cross-sectional view taken substantially along the line 9—9 of FIG. 7.

Each of the carriage trucks 48 comprises a downwardly-open channel member formed of sheet steel with the upper web 50 joined integrally to a pair of depending flanges 51 and 52 which flank the associated tubular track bar 44 as best seen in FIG. 9. The flanged rollers 42 are preferably molded of nylon in two halves journaled on axle pins 60 spanning the flanges of the trucks, and the forward roller is preferably larger so as to endure the greater expected load. To prevent lifting of the carriage from the inclined track bar, pins 64 span the side walls 51 and 52 beneath the bars and to prevent disengagement of the carriage and track if the chair is lifted by other than its base.

The upper rearward ends of the inclined track bars 44 are secured to and supported by a wooden cross plate 65 which is secured between parallel base runners 66. The upper edge of the cross plate 65 is formed with a pair of upwardly opening notches 67 (FIG. 7) to receive the ends of the track bars 44 and securing pins 68 are driven from each end wall of the base plate 65 into and through aligned apertures in the inclined bars to pin the track bars in place.

As best seen in FIGS. 7 and 8, the lower forward ends of the tubular track bars 44 rest upon a front cross plate 72, which also spans and is secured to the base runners 66. A quick interlocking connection with the front ends of inclined bars 44, is provided by a pair of locking brackets 74 each screwed to the front cross plate 74, and having a tapered locator tongue 75 which projects into the hollow interior of each track bar 44 and abuts its side walls 63 as well as its bottom wall 77. By way of example only, the track bars 44 are pitched downwardly at an incline of 1 inch vertical drop per 8 inches of length of the bars.

To assure quiet and substantially noise free operation and to limit the shock and noise when the chassis 20 completes its travel in either its forward or rearward directions, the track bars 44 are provided at both ends with stops 80 and 82 which limit and cushion the travel of the chair chassis. The stops comprise a pair of elastic bumper buttons 83 secured to opposite sides of the track bar 44 by rivet extending through the bumpers and the track bar. The bumpers are positioned to be engaged respectively by the front and rear edges of the depending flanges of the carriage trucks 48 to snub the movement of the carriage at its extreme forward and rearward positions respectively.

Figure 3:
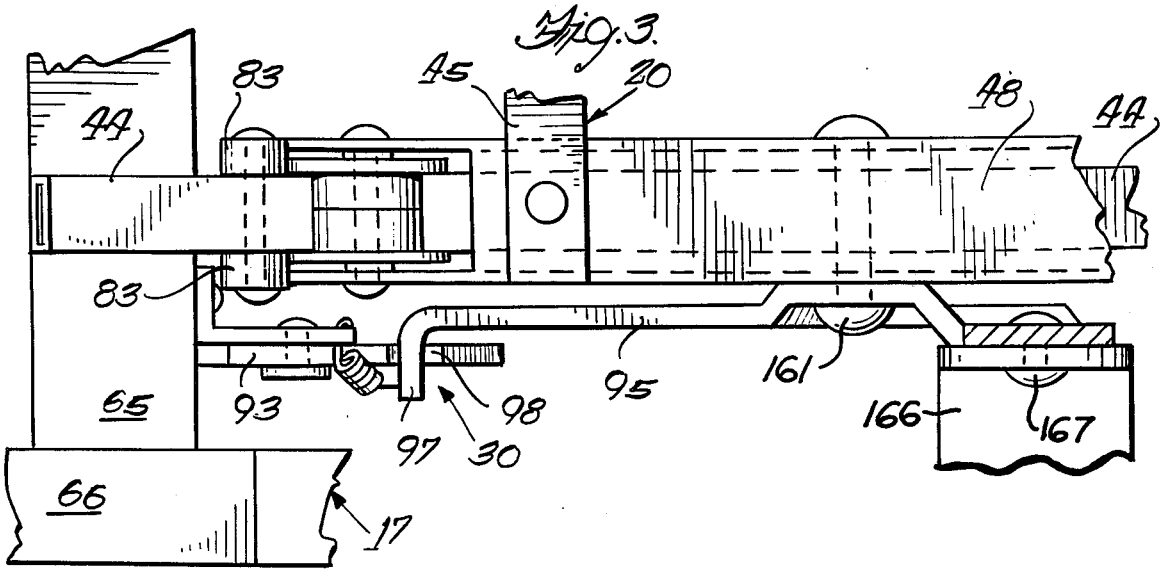
FIG. 3 is a fragmentary plan view of the trackage and latch securing the chair chassis in the rearward, upright sitting position shown in FIG. 1.
Figure 10:
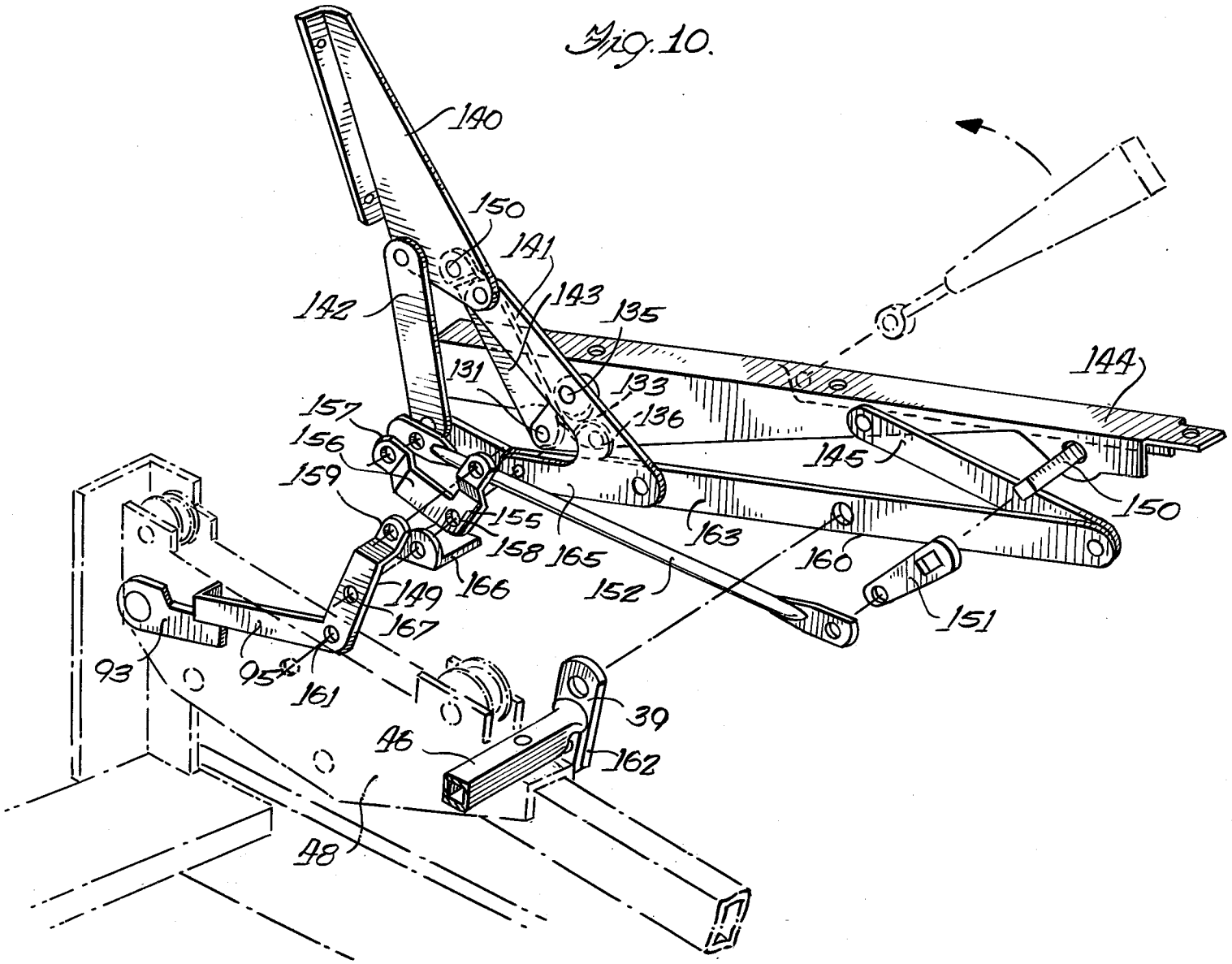
FIG. 10 is an "exploded" assembly view of the chair linkage, useful along the FIGS. 5, 6, and 7 to facilitate illustration of the association of the recliner lock and chassis latch with the footrest extension mechanism.

The latching means 30 for securing the chair chassis 20 in the rearward sitting position shown in FIG. 1 comprises a latch dog 93 mounted on the base 17 for cooperation with a latch lever 95, as best seen in FIGS. 3, 7 and 10. More specifically, when the chair chassis 20 is in its rearward position, a crosswise extending latch tab 97 on the latching lever 95 is seated behind the upstanding hook 98 of the latch dog 93, and thus holds the linkage mechanism and the chair chassis 20 against forward movement.

The latch dog 93 is a metal stamping pivoted by means of a shoulder rivet 101 to an angle iron bracket 104 at the rear corner of the base frame 17. The latch dog 93 is biased upwardly to its locking position by a tension spring 105 having its upper end hooked into an aperture in a supporting bracket 104 and its lower end secured to a sideward extending tab 109 struck from the latch dog 93. The forward edge of the latch has a chamfered camming surface 111 which enables the tab 97 of the latch lever 95 to override and depress the dog 93 upon the return of the chair chassis 20, with footrest retracted, to the latched, rearward sitting position of FIGS. 1 and 4.

Figure 5:
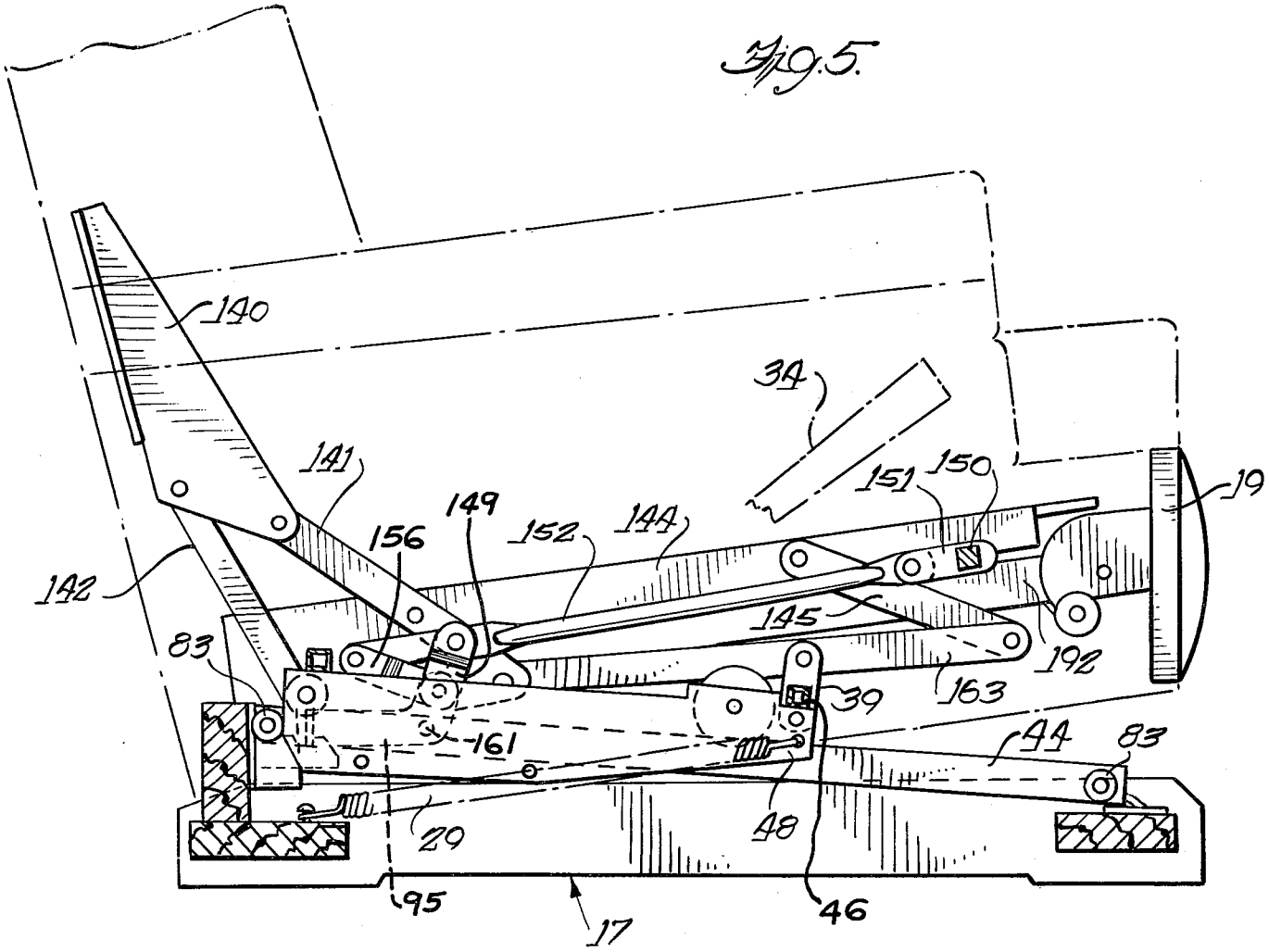
FIG. 5 is an interior or sectional elevational view of the far-side linkage illustrating the seat and back support linkage, the recliner lock, and the latch mechanism which normally prevents forward movement of the chassis.

The automatic return of the chair chassis 20 to the rearward position when the occupant arises from the chair, and the self-latching action, is provided by a pair of elongated coiled tension springs 29 only one of which is shown (FIGS. 5 and 6). Each is secured at its rearward end by a wood screw to the top of a rearward cross plate 121 extending between base runners 66 beneath the cross plate 65, and is hooked to a carriage truck 48 by hook end 123 thereon inserted into an aperture 125 in the truck flange 52 at the front end thereof. The return springs 29 extend generally horizontally beneath the chair chassis 20 and between and generally parallel to the inclined track bars 44 to draw the chair chassis 20 up the inclined track from the forward position shown in FIGS. 2 and 6 to the rearward position of FIGS. 1 and 5, when the occupant has risen from the chair.

THE MOUNTING OF THE CHAIR PARTS ON THE CARRIAGE FOR PITCH CHANGE AND SUBSEQUENT RECLINE, AND THE OPERATION OF THE RECLINER LOCK AND CARRIAGE LATCH

As earlier indicated, we have utilized in the wall-clearing recliner of the present invention the basic recliner linkage of our U.S. Pat. No. 3,896,172 for the interrelated movement of the chair back and the chair seat during reclining movement and we have utilized the retractable footrest mechanism of our U.S. Pat. No. 3,869,169, which is illustrated therein in the context of a combination rocker-recliner.

In addition, we have likewise incorporated in the chair of the present invention a portion of the locking mechanism of our U.S. Pat. No. 3,869,170 which we have modified appropriately to achieve, for the sake of the chair of the present invention, the additional functions of releasing the carriage latch for the forward travel of the chair to its forward position, and the accomplishment of a slight change of pitch of the chair seat and back as a unit upon the extension of the legrest. The locking mechanism continues in the chair of the present invention to serve one of the functions of its form illustrated in U.S. Pat. No. 3,869,170, namely, the prevention of the recline of the back of the chair while the footrest remains retracted. The latter aspect of operation is as important in a wall-clearing recliner as it is in the rocker-recliner context of our earlier U.S. Pat. No. 3,869,170, although for different reasons.

Accordingly, it will be recognized, referring particularly to FIG. 10, that the chair back 140 and the chair seat 144 are both mounted upon an intermediate chassis rail 163 and are movable with respect thereto into and out of reclining attitude after the recliner locking mechanism has been conditioned, by the extension of the footrest, to permit the reclining action.

As explained in detail in our U.S. Pat. No. 3,869,172, the back 140 of the chair is mounted on the chassis rail 163 by means of a pair of links 141 and 142 so as to constitute with the chassis rail and the supporting links a four-bar linkage. The seat frame 144 is supported for coordinated movement with the backrest. Its support includes, in its forward part, a link 145 which is pivoted both to the seat frame 144 and to the chassis rail 163 so as to elevate the seat frame relative to the chassis rail upon forward movement of the seat. In its rearward portion, the seat frame is pivotally suspended at 136 from a bell crank 133 which is pivotally suspended at 135 from the back support link 141 of the chair back, and controlled in its movement relative thereto by a control link 143 connected between the bell crank 133, at 131, and the chair back 140, at 150. The coordinated action of the back and seat is fully described in U.S. Pat. No. 3,869,172 and need not be further expanded here.

The retractable footrest 19 is suspended from the seat frame 144 in exactly the manner of our earlier U.S. Pat. No. 3,869,169, being carried to and from the extended position, and supported in the extended position, by a pair of roller-mounted parallel rails 192 which are propelled fore and aft by the extension linkage illustrated in that patent, and collectively referred to by the reference number 35 in FIG. 4 thereof. It need be referred to here only to the extent of making clear, for the sake of the present invention, that we have utilized the footrest extension action, i.e., the occupant's operation of the hand lever 34 to extend the footrest, as the means of "conditioning" the chair for subsequent recline, of altering the pitch of the chair back and seat as a unit on the carriage 40, and of unlatching the carriage for its forward movement on the chair base under the influence of the weight of the occupant.

Figure 4:
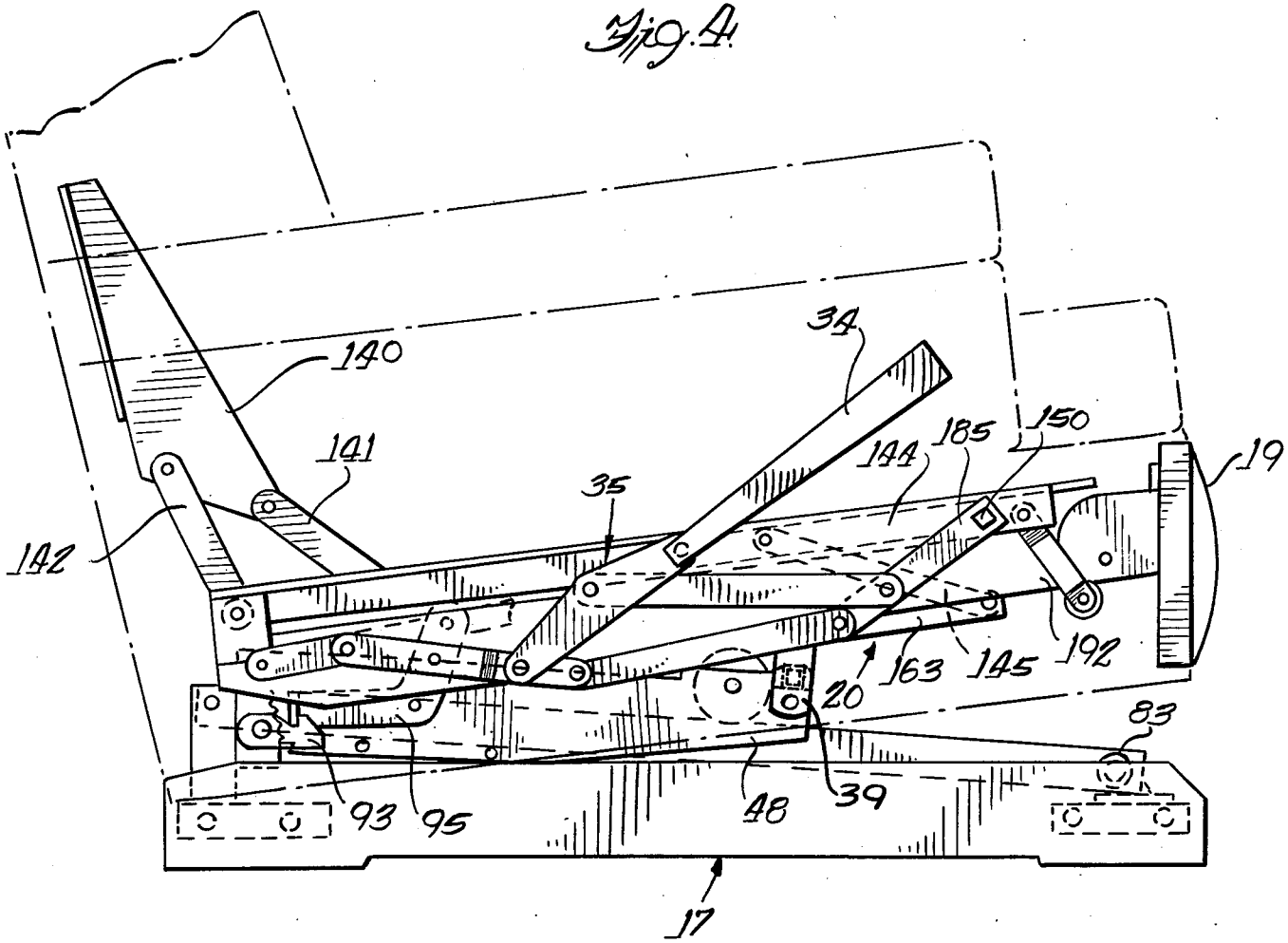
FIG. 4 is a side elevational view of the near-side footrest extending linkage operable by a manner lever which also functions to release the latching means.

The combined actions just referred to will best be understood by detailed reference to FIG. 10 for overall orientation, with auxiliary reference to FIGS. 4, 5 and 7.

As explained in our U.S. Pat. No. 3,869,169, the footrest extension linkages are repeated on opposite sides of the chair, each being operated concurrently by the operation of a single hand lever 34 to extend and to retract the two footrest supporting rails 192 in unison. To achieve this united movement, the footrest extension linkages on opposite sides of the chair are cross-connected by a shaft 150 journaled in the seat frame members 144 at the forward ends thereof, and secured to the forwardmost link 185 of each extension linkage (FIG. 4). The turning of the cross-connecting shaft, a square shaft as illustrated in FIGS. 4, 5, and 10, by the operation of the hand lever 34 is utilized to operate the recliner lock and carriage latch, as well as to effect the pitch change earlier mentioned. This is accomplished by providing the cross-connecting shaft 150 with a crank arm 151 (FIGS. 5 and 10) which in turn is connected rearwardly to the carriage latch and to the recliner linkage by the tubular thrust link 152.

From our earlier U.S. Pat. No. 3,869,170, it will be recalled that the recliner lock comprises essentially a pair of links, 155 and 149, which are connected together at 159 as a toggle, the link 155 being pivoted at 158 to a rearward extension 165 of the forward back support link 141, and the link 149 being pivoted at 167 to a bracket 166 secured to the chassis rail 163. When the backrest 140 is upright, as in FIGS. 4, 5, and 10, the pivots 158 and 167 of the two toggle links 155 and 149 coincide; if the two toggle links are also aligned with their axes in the direction of relative movement of the forward backrest support link 141 on the chassis rail 163 (as in FIG. 10), they effectively prevent that movement. Conversely, if the two links 155 and 149 which constitute the toggle are rotated as a unit out of alignment with the direction of relative movement of the backrest support link 141 on the chassis rail 163, the two links of the toggle are incapable of opposing the reclining movement of the backrest and merely "scissors" idly in accompaniment to that movement.

The details will best be understood from FIG. 10, which also illustrates the mounting of the chassis rail upon the movable carriage for the accomplishment of the pitch change which accompanies the disabling of the recliner locking toggle 155–149 and the release of the carriage latch 95.

The thrust link 152 extending rearward from the crank arm 151 is pivoted at 157 to the bell crank arm 156 of the toggle link 155. The link 155, which extends upwardly in FIG. 10 is one-half of the aforementioned locking toggle which prevents the recline of the backrest.

The other half of the locking toggle is the upstanding arm 149 of the carriage latching lever 95. The latter has three separate pivotal connections, which should be carefully noted. At its extreme end 159, it is pivoted to the link 155 to form the "knee" of the aforementioned recliner locking toggle. Intermediate the length of the arm 149, it is pivoted at 167 to the bracket 166 which is secured to the chassis rail 163. At its elbow 161, the latching lever 95 is pivoted to the carriage truck 48. It will be seen, therefore, that between the pivots 161 and 167, the latching lever 95 constitutes a movable support link for the rearward portion of the chassis rail 163, as well as performing its other functions. The forward portion of the chassis rail 163 is movably carried by the upstanding support link 39 which is pivoted to the front cross bar 46 of the carriage at 162 and to the chassis rail 163 at 160.

Accordingly, the chassis rail 163, the backrest 140, the seat frame 144, and the legrest 19 which it supports, are all movably mounted as a unit upon the carriage 40 by the latching lever 95 and the forward support link 39. The length and the inclination of the latching lever 95 between its pivotal connection 161 to the carriage truck 48 and its pivotal connection 167 to the bracket 166 on the chassis rail 163, together with the length and the inclination of the forward chassis-rail supporting link 39, is such as to provide a slight rearward or reclining rotation of the chassis rail 163, and all which it supports, as an incident to the extension of the legrest.

The operation, to that extent, is as follows: When the hand lever 34 is drawn rearwardly to extend the legrest, the cross shaft 150 is rotated to turn the crank arm 151 counterclockwise as seen in FIG. 10, hauling forward on the thrust link 152. The thrust link 152, by its forward motion, rotates the toggle 155–149 clockwise as seen in FIG. 10, which, in turn, also rocks the entire latching lever 95 clockwise as seen in FIG. 10 and FIGS. 4 and 5. In this single action, three events have occurred:

First: The latching tongue 97 on the latching lever 95 is lifted clear of the dog 93 and, assuming the chair is occupied, it rolls downhill from the position of FIG. 1 to the position of FIG. 2, with the legrest of the chair extended.

Second: The clockwise rotation of the latching lever 95 on the carriage truck 48 shifted the chassis rail 163 forwardly of the carriage (FIG. 5 to FIG. 6), dropping its back end, and thus achieving a slight reclining rotation of the backrest, seat, and footrest as a unit.

Third: The clockwise rotation of the recliner locking toggle 155–149 out of alignment with the direction of movement of the pivot 158 on the rearward extension 165 of the forward back support link 141 not permits the recline of the backrest from the upright position, as depicted by the two positions of the backrest in FIGS. 2 and 6.

From the foregoing it will be seen that the present invention provides a reclining chair which can be positioned with its back close to a wall, and which can be shifted forwardly to provide clearance for reclining with a minimum of effort as contrasted to the prior art, wall-clearing recliners. This is achieved by using the weight of the occupant in combination with an inclined track to shift the chair chassis forwardly, whereas, in the known wall-clearing recliners, the occupant must exert considerable force in the reclining of the backrest to shift the movable chair chassis forward and back. In the chair of the invention, the movable chassis is self-returning to the sitting position by spring action, and latches itself in that position after the occupant, having righted the backrest and retracted the footrest, rises from the chair.

Preferably, the action which is employed to extend the footrest is also utilized to release the carriage latch to permit the free downhill movement of the chassis under the influence of the occupant's weight.

While a preferred embodiment has been shown and described, it will be understood that there is no intent to limit the invention by the specific disclosure but rather to cover all modifications and alternative constructions falling within the spirit and the scope of the invention as defined in the appended claims.

What is claimed is:

1. In a wall-clearing reclining chair comprising a base, a chair chassis movably supported by said base, a chair back on said chassis, a chair seat on said chassis, an extendible footrest on said chassis, and means on said chassis for shifting said chair back and chair seat between a sitting position and a reclined position and for extending said footrest, the improvement comprising means supporting said chassis for forward and downward travel along said base by the weight of the occupant from a rearward sitting position with the footrest retracted to a forward position at which the chair back may be reclined with the footrest extended without rearward projection of the back farther rearwardly than in said sitting position latch means for latching said chair chassis at said sitting position, means operable by the occupant to actuate said latch means to release said chair chassis for forward shifting movement under the occupant's weight, and a biasing means activated by said forward and downward travel to return said chair chassis rearwardly to the sitting position when the occupant rises from the chair.

2. A reclining chair in accordance with claim 1 in which said means operable by the occupant to release the latch is actuated by extending said footrest.

3. In a wall-clearing recliner chair, the combination comprising a base, a chair seat, a chair back, and a footrest movable from a stowed position to an extended position for supporting the feet of an occupant in a chair, carriage means carrying said chair back, chair seat and footrest on an inclined track on said base for movement under the weight of the occupant from a rearward sitting position in which the upper end of the chair back is disposed at a predetermined position relative to said base and a forward position in which said upper end of said chair back has shifted substantially forward relative to the base, linkage means interconnecting said chair back and chair seat with said carriage for reclining movement of the back and seat thereon, and locking means normally preventing recline of the chair from said rearward sitting position, said locking means being disabled coincident with the extension of the footrest.

4. A recliner chair in accordance with claim 3 in which spaced track bars are fixedly secured to said base and are inclined downwardly and forwardly relative to said base, and said carriage means have spaced roller means in rolling engagement with said track bars.

5. A recliner chair in accordance with claim 3 in which spring means connected between said base and said carriage is loaded by movement of said carriage from the rearward to forward position to return the same to the rearward position when the occupant rises from the chair.

6. A recliner chair in accordance with claim 3 in which a latch means associated with said base latches said carriage in the rearward position and manually operable means are provided for operating said latch means to allow shifting of said carriage to the forward position.

7. In a wall-clearing reclining chair, the combination comprising a base, a chair seat, a chair back and a foot rest movable from a stowed position to an extended position for supporting the feet of an occupant in the chair, carriage means supported upon a downwardly and forwardly inclined track means on said base and carrying said chair back, chair seat and foot rest on said base from a rearward sitting position in which the upper end of the chair back is disposed at a predetermined position relative to said base to a forward position in which said upper end of said chair back has shifted substantially forward relative to the base, means for latching said carriage in said rearward sitting position, a manually operable means to release said carriage latch for forward shifting movement of said carriage along said inclined track means said chair back and said chair seat having a first angular relationship to said carriage in said sitting position, and linkage means supporting said chair back, chair seat, and foot rest upon said carriage and operable upon movement to said forward position for shifting said foot rest to the extended position and for shifting said chair back and seat into a second angular relationship with said carriage and for conditioning said chair back for further recline relative to said carriage at the will of the occupant, and spring means biasing said carriage to shift rearwardly from the forward position to the rearward position when the occupant leaves the chair.

* * * * *